US009802790B2

(12) United States Patent
Kattainen et al.

(10) Patent No.: US 9,802,790 B2
(45) Date of Patent: Oct. 31, 2017

(54) DRIVE DEVICE OF AN ELEVATOR WITH SAFETY SYSTEM

(71) Applicant: KONE Corporation, Helsinki (FI)

(72) Inventors: Ari Kattainen, Hyvinkää (FI); Pasi Raassina, Numminen (FI); Tapio Saarikoski, Hyvinkää (FI); Lauri Stolt, Helsinki (FI); Arto Nakari, Hyvinkää (FI); Antti Kallioniemi, Jokela (FI)

(73) Assignee: KONE CORPORATION, Helsinki (FI)

( * ) Notice: Subject to any disclaimer, the term of this patent is extended or adjusted under 35 U.S.C. 154(b) by 438 days.

(21) Appl. No.: 14/532,753

(22) Filed: Nov. 4, 2014

(65) Prior Publication Data

US 2015/0075917 A1 Mar. 19, 2015

Related U.S. Application Data

(63) Continuation of application No. PCT/FI2013/050543, filed on May 20, 2013.

(30) Foreign Application Priority Data

May 31, 2012 (FI) ..... 20125596

(51) Int. Cl.
*B66B 1/34* (2006.01)
*B66B 5/02* (2006.01)
(Continued)

(52) U.S. Cl.
CPC ..... *B66B 5/02* (2013.01); *B66B 1/32* (2013.01); *B66B 5/00* (2013.01); *B66B 5/0031* (2013.01);
(Continued)

(58) Field of Classification Search
CPC .... B66B 5/02; B66B 1/32; B66B 5/00; B66B 5/0031; B66B 5/06; B66B 13/22; B66B 1/30
(Continued)

(56) References Cited

U.S. PATENT DOCUMENTS 4,085,823 A * 4/1978 Caputo ..... B66B 1/3492 187/293
4,308,936 A * 1/1982 Caputo ..... B66B 1/36 187/316
(Continued)

FOREIGN PATENT DOCUMENTS

CN 1586033 A 2/2005
CN 1972855 A 5/2007
(Continued)

*Primary Examiner* — Anthony Salata
(74) *Attorney, Agent, or Firm* — Birch, Stewart, Kolasch & Birch, LLP

(57) ABSTRACT

A drive device of an elevator includes a DC bus, a motor bridge connected to the DC bus for the electricity supply of the elevator motor, a control circuit with which control circuit the operation of the motor bridge is controlled by producing control pulses in control poles of high-side and low-side switches of the motor bridge, a brake controller, which comprises a switch for supplying electric power to an electromagnetic brake, a brake control circuit, with which the operation of the brake controller is controlled, an input circuit for the safety signal to be disconnected/connected from outside the drive device, drive prevention logic and brake drop-out logic connected to the input circuit and configured to prevent the passage of control pulses to the control poles of the high-side and/or low-side switches when the safety signal is disconnected.

20 Claims, 8 Drawing Sheets

(51) Int. Cl.

| | |
|---|---|
| ***B66B 1/32*** | (2006.01) |
| ***B66B 5/00*** | (2006.01) |
| ***B66B 5/06*** | (2006.01) |
| ***B66B 13/22*** | (2006.01) |
| *B66B 1/30* | (2006.01) |

(52) U.S. Cl.
CPC ..... *B66B 5/06* (2013.01); *B66B 13/22* (2013.01); *B66B 1/30* (2013.01)

(58) Field of Classification Search
USPC ..... 187/247, 277, 288, 289, 293, 296, 297, 187/391, 393
See application file for complete search history.

(56) References Cited

U.S. PATENT DOCUMENTS

| | | | | |
|---|---|---|---|---|
| 6,056,088 | A | 5/2000 | Gerstenkorn | |
| 7,669,697 | B2 * | 3/2010 | Ueda | B66B 5/02 187/292 |
| 8,230,977 | B2 * | 7/2012 | Thumm | B66B 1/34 187/247 |
| 9,067,762 | B2 * | 6/2015 | Fargo | B66B 1/302 |
| 9,422,135 | B2 * | 8/2016 | Rogers | B66B 5/0018 |
| 9,457,987 | B2 * | 10/2016 | Della Porta | B66B 1/32 |
| 2004/0207359 | A1 | 10/2004 | Jahkonen | |
| 2007/0187185 | A1 | 8/2007 | Abraham et al. | |
| 2009/0120725 | A1 | 5/2009 | Syrman et al. | |
| 2009/0301819 | A1 | 12/2009 | Agirman et al. | |
| 2014/0202798 | A1 * | 7/2014 | Kattainen | B66B 5/0031 187/393 |
| 2015/0053507 | A1 * | 2/2015 | Kattainen | B66B 1/32 187/288 |
| 2015/0053508 | A1 * | 2/2015 | Kattainen | B66B 1/32 187/289 |
| 2015/0075915 | A1 * | 3/2015 | Stolt | B66B 1/30 187/247 |
| 2015/0210506 | A1 * | 7/2015 | Kattainen | H02H 3/165 187/289 |
| 2016/0167921 | A1 * | 6/2016 | Kattainen | B66B 1/24 187/247 |
| 2017/0063259 | A1 * | 3/2017 | Schoenlinner | H02P 3/04 |

FOREIGN PATENT DOCUMENTS

| | | | |
|---|---|---|---|
| CN | 101360674 | A | 2/2009 |
| CN | 201737550 | U | 2/2011 |
| JP | 11-165963 | A | 6/1999 |
| JP | 2005-343602 | A | 12/2005 |
| WO | WO 00/51929 | A1 | 9/2000 |
| WO | WO 2008/031915 | A | 3/2008 |
| WO | WO 2008/129672 | A1 | 10/2008 |
| WO | WO 2011051571 | A1 | 5/2011 |

* cited by examiner

1 - frequency converter
2A, 2B DC intermediate circuit
3 - motor bridge
5 - control circuit
6 - electric motor
7 - brake controller
11 - brake control circuit
13 - safety signal
15, 16 - special safety logic
20 - electronic supervision unit
25 - electricity network
26 - rectifier
27, 28 - sensors
30 - communications bus
35 - elevator control unit 2A, 2B - DC intermediate circuit
3 - motor bridge
4A - high-side IGBT transistor
4B - low-side IGBT transistor
5 - control circuit
12 - input circuit
13 - safety signal
14 - safety relay
15 - special safety logic
20 - electronic supervision unit
21 - opto-isolator
23 - signal switch
40 - DC voltage source
R, S, T - outputs 2A, 2B - DC intermediate circuit
7 - brake controller
8A - IGBT transistor
10 - brake cease coil
11 - brake control circuit
12 - input circuit
13 - safety signal
14 - contacts
16 - brake drop-out logic
21 - isolator
23 - signal switch
36 - transformer
37 - rectifier
38 - current damping circuit
39 - MOSFET transistor
40 - DC voltage source 2A, 2B - DC intermediate circuit
7 - brake controller
8A - IGBT transistor
10 - brake cease coil
11 - brake control circuit
12 - input circuit
13 - safety signal
14 - contacts
16 - brake drop-out logic
21 - isolator
23 - signal switch
36 - transformer
37 - rectifier
38 - current damping circuit
39 - MOSFET transistor
40 - DC voltage source 2A, 2B - DC intermediate circuit
7 - brake controller
8A - IGBT transistor
10 - brake cease coil
11 - brake control circuit
12 - input circuit
13 - safety signal
14 - contacts
16 - brake drop-out logic
21 - isolator
23 - signal switch
36 - transformer
37 - rectifier
38 - current damping circuit
39 - MOSFET transistor
40 - DC voltage source
45 - MELF resistor
46 - transistor 1 - frequency converter
2A, 2B DC intermediate circuit 3 - motor bridge
5 - control circuit
6 - electric motor
7 - brake controller
11 - brake control circuit
13 - safety signal
14 - contacts
15, 16 - special safety logic 17 - indicator logic
18 - signal
20 - electronic supervision unit 25 - electricity network
26 - rectifier
27, 28 - sensors
30 - communications bus
35 - elevator control unit
40 - DC voltage source
41 - diodes

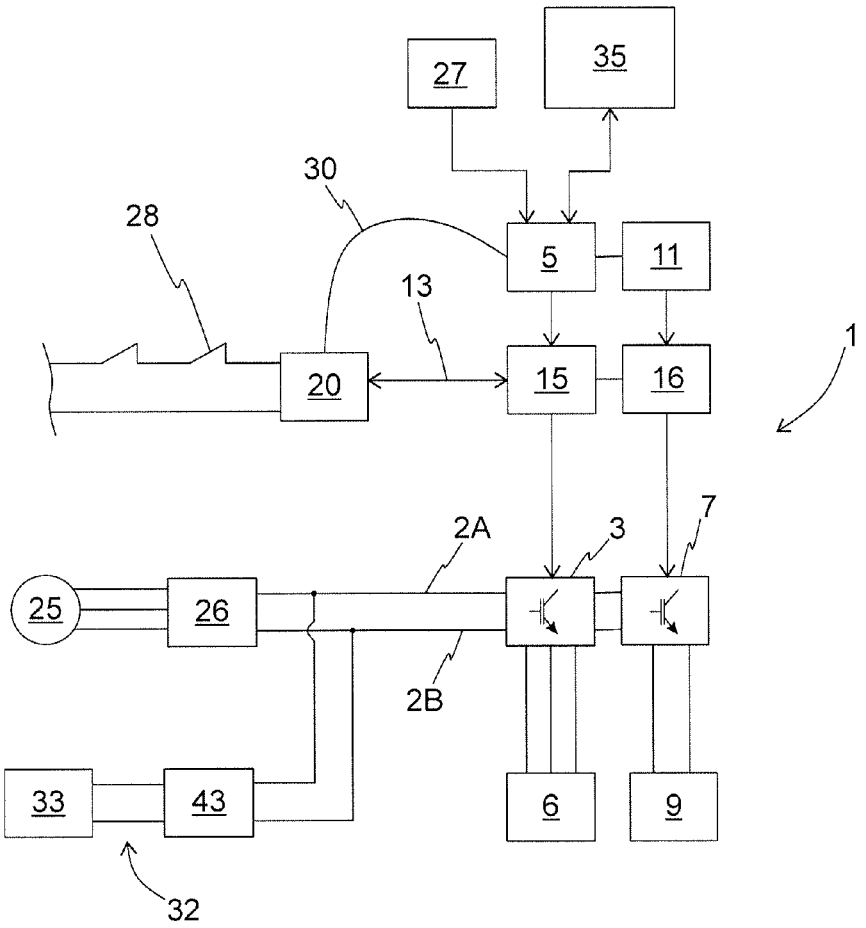

Fig. 7

1 - frequency converter
2A, 2B DC intermediate circuit
3 - motor bridge
5 - control circuit
6 - electric motor
7 - brake controller
9 - brakes
11 - brake control circuit
13 - safety switch
15, 16 - special safety logic
20 - electronic supervision unit
25 - electricity network
26 - rectifier
27, 28 - sensors
30 - data transfer bus
32 - emergency drive apparatus
33 - battery pack
35 - elevator control unit
40 - DC voltage source
43 - DC/DC transformer 1 - frequency converter
12 - input circuit
13 - safety signal
15, 16 - special safety logic
27, 28 - sensors
34 - safety circuit
40 - DC voltage source
41 - diodes
44 - safety relay

DRIVE DEVICE OF AN ELEVATOR WITH SAFETY SYSTEM

CROSS REFERENCE TO RELATED APPLICATIONS

This application is a Continuation of PCT International Application No. PCT/FI2013/050543 filed on May 20, 2013, which claims priority under 35 U.S.C. §119(a) to Patent Application No. 20125596 filed in Finland on May 31, 2012, all of which are hereby expressly incorporated by reference into the present application.

FIELD OF THE INVENTION

The invention relates to the safety systems of the drive devices of an elevator.

BACKGROUND OF THE INVENTION

In an elevator system, there must be a safety system according to safety regulations, by the aid of which safety system the operation of the elevator system can be stopped e.g. as a consequence of a defect or of an operating error. The aforementioned safety system comprises a safety circuit, which comprises safety switches in series, which switches measure the safety of the system. Opening of a safety switch indicates that the safety of the elevator system has been jeopardized. In this case operation of the elevator system is interrupted and the elevator system is brought into a safe state by disconnecting with contactors the power supply from the electricity network to the elevator motor. In addition, the machinery brakes are activated by disconnecting with a contactor the current supply to the electromagnet of the machinery brake.

Contactors, as mechanical components, are unreliable because they only withstand a certain number of current disconnections. The contacts of a contactor might also weld closed if they are overloaded, in which case the ability of the contactor to disconnect the current ceases. A failure of a contactor might consequently result in impaired safety in the elevator system.

As components, contactors are of large size, for which reason devices containing contactors also become large. On the other hand, it is a general aim to utilize built space as efficiently as possible, in which case the disposal of large-sized elevator components containing contactors may cause problems.

Consequently there would be a need to find a solution for reducing the number of contactors in an elevator system without impairing the safety of the elevator system.

AIM OF THE INVENTION

The aim of the invention is to resolve one or more of the drawbacks disclosed above. One aim of the invention is to disclose a drive device of an elevator, which is implemented without contactors.

To achieve this aim the invention discloses a drive device of an elevator according to claim 1. The preferred embodiments of the invention are described in the dependent claims. Some inventive embodiments and inventive combinations of the various embodiments are also presented in the descriptive section and in the drawings of the present application.

SUMMARY OF THE INVENTION

The drive device of an elevator according to the invention comprises a DC bus and also a motor bridge connected to the DC bus for the electricity supply of the elevator motor. The motor bridge comprises high-side and low-side switches for supplying electric power from the DC bus to the elevator motor when driving with the elevator motor, and also from the elevator motor to the DC bus when braking with the elevator motor. The drive device comprises a control circuit of the motor bridge, with which control circuit the operation of the motor bridge is controlled by producing control pulses in the control poles of the high-side and low-side switches of the motor bridge, a brake controller, which comprises a switch for supplying electric power to the control coil of an electromagnetic brake, a brake control circuit, with which the operation of the brake controller is controlled by producing control pulses in the control pole of the switch of the brake controller, an input circuit for the safety signal, which safety signal can be disconnected and connected to the input circuit from outside the drive device, drive prevention logic, which is connected to the input circuit and is configured to prevent the passage of control pulses to the control poles of the high-side and/or low-side switches of the motor bridge when the safety signal is disconnected, and also brake drop-out logic, which is connected to the input circuit and is configured to prevent passage of the control pulses to the control pole of the switch of the brake controller when the safety signal is disconnected. A DC bus refers here to a DC voltage power bus, i.e. a part of the main circuit conducting/transmitting electric power, such as the busbars of the DC intermediate circuit of a frequency converter.

The power supply from the DC bus via the motor bridge to the elevator motor can consequently be disconnected without mechanical contactors, by preventing the passage of control pulses to the control poles of the high-side and/or low-side switches with the drive prevention logic according to the invention. Likewise the power supply to the control coil of each electromagnetic brake can be disconnected without mechanical contactors, by preventing the passage of control pulses to the control pole of the switch of the brake controller with the brake drop-out logic according to the invention. The switch of the brake controller, as also the high-side and low-side switches of the motor bridge, are most preferably solid-state switches, such as IGBT transistors, MOSFET transistors or bipolar transistors.

In a preferred embodiment of the invention the aforementioned brake controller is connected to the DC bus, and the brake controller comprises the aforementioned switch for supplying power from the DC bus to the control coil of the electromagnetic brake. Consequently, also the energy returning to the DC bus in connection with braking of the elevator motor can be utilized in the brake control, which improves the efficiency ratio of the drive device of an elevator. In addition, the main circuit of the drive device of an elevator is simplified when a separate electricity supply for the brake controller does not need to be arranged in the drive device.

The invention enables the integration of the power supply device for the elevator motor and of the brake controller into the same drive device, preferably into the frequency converter of the hoisting machine of the elevator. This is of paramount important because the combination of the power supply device for the elevator motor and of the brake controller is indispensable from the viewpoint of the safe operation of the hoisting machine of the elevator and, consequently, from the viewpoint of the safe operation of the whole elevator. The drive device according to the invention can also be connected as a part of the safety arrangement of an elevator via a safety signal, in which case the safety arrangement of the elevator is simplified and it can be implemented easily in many different ways. Additionally, the combination of the safety signal, drive prevention logic and brake drop-out logic combination according to the invention enables the drive device to be implemented completely without mechanical contactors, using only solid-state components. Most preferably the input circuit of the safety signal, the drive prevention logic and the brake drop-out logic are implemented only with discrete solid-state components, i.e. without integrated circuits. In this case analysis of the effect of different fault situations as well as of e.g. EMC interference connecting to the input circuit of the safety signal from outside the drive device is facilitated, which also facilitates connecting the drive device to different elevator safety arrangements.

Consequently, the solution according to the invention simplifies the structure of the drive device, reduces the size of the drive device and increases reliability. Additionally, when eliminating contactors also the disturbing noise produced by the operation of contactors is removed. Simplification of the drive device and reduction of the size of the drive device enable the disposal of a drive device in the same location in the elevator system as the hoisting machine of the elevator. Since high-power electric current flows in the current conductors between the drive device and the hoisting machine of the elevator, disposing the drive device in the same location as the hoisting machine of the elevator enables shortening, or even eliminating, the current conductors, in which case also the EMC interference produced by operation of the drive device and of the hoisting machine of the elevator decreases.

In a preferred embodiment of the invention the drive prevention logic is configured to allow passage of the control pulses to the control poles of the high-side and low-side switches of the motor bridge when the safety signal is connected, and the brake drop-out logic is configured to allow passage of the control pulses to the control pole of the switch of the brake controller when the safety signal is connected. Consequently, a run with the elevator can be enabled just by connecting the safety signal, in which case the safety arrangement of the elevator is simplified.

In a preferred embodiment of the invention the drive device comprises indicator logic for forming a signal permitting startup of a run. The indicator logic is configured to activate the signal permitting startup of a run when both the drive prevention logic and the brake drop-out logic are in a state preventing the passage of control pulses, and the indicator logic is configured to disconnect the signal permitting startup of a run if at least either of the drive prevention logic and the brake drop-out logic are in a state permitting the passage of control pulses. The drive device comprises an output for indicating the signal permitting startup of a run to a supervision logic external to the drive device.

In a preferred embodiment of the invention the electricity supply to the drive prevention logic is arranged via the signal path of the safety signal and the signal path of the control pulses from the control circuit of the motor bridge to the drive prevention logic is arranged via an isolator.

In a preferred embodiment of the invention the electricity supply to the brake drop-out logic is arranged via the signal path of the safety signal the signal path of the control pulses from the brake control circuit to the brake drop-out logic is arranged via an isolator.

By arranging the electricity supply to the drive prevention logic/brake drop-out logic via the signal path of the safety signal, it can be ensured that the electricity supply to the drive prevention logic/brake drop-out logic disconnects, and that the passage of control pulses to selected control poles of the switches of the motor bridge and the brake controller consequently ceases, when the safety signal is disconnected. In this case by disconnecting the safety signal, the power supply to the electric motor as well as to the control coil of the electromagnetic brake can be disconnected in a fail-safe manner without separate mechanical contactors.

In this context an isolator means a component that disconnects the passage of an electric charge along a signal path. In an isolator the signal is consequently transmitted e.g. as electromagnet radiation (opto-isolator) or via a magnetic field or electrical field (digital isolator). With the use of an isolator, the passage of charge carriers from the control circuit of the motor bridge to the drive prevention logic as well as from the brake control circuit to the brake drop-out logic is prevented e.g. when the control circuit of the motor bridge/brake control circuit fails into a short-circuit.

In the most preferred embodiment of the invention the drive prevention logic comprises a bipolar or multipolar signal switch, via which the control pulses travel to the control pole of a switch of the motor bridge, and at least one pole of the signal switch is connected to the input circuit (i.e. to the signal path of the safety signal) in such a way that the signal path of the control pulses through the signal switch breaks when the safety signal is disconnected.

In one preferred embodiment of the invention the aforementioned signal switch of the drive prevention logic/brake drop-out logic is a transistor, via the control pole (gate) of which control pulses travel to the photodiode of the opto-isolator of the controller of an IGBT transistor. In this case the signal path of the control pulse to the gate of the transistor is configured to travel via a metal film resistor (MELF resistor). The aforementioned transistor can be e.g. a bipolar transistor or a MOSFET transistor.

In a preferred embodiment of the invention the aforementioned signal switch is fitted in connection with the control pole of each high-side switch of the motor bridge and/or in connection with the control pole of each low-side switch of the motor bridge.

In a preferred embodiment of the invention the aforementioned electricity supply occurring via the safety signal is configured to be disconnected by disconnecting the safety signal.

In one preferred embodiment of the invention the drive device comprises a rectifier connected between the AC electricity source and the DC bus.

In a preferred embodiment of the invention the drive device is implemented fully without mechanical contactors.

The drive device according to the invention is suited for use in an elevator safety arrangement, which comprises sensors configured to monitor functions that are important from the viewpoint of the safety of the elevator, an electronic supervision unit, which comprises an input for the data formed by the aforementioned sensors monitoring the safety of the elevator, and also a drive device according to the invention for driving the hoisting machine of the elevator. The signal conductor of the safety signal is led from the electronic supervision unit to the drive device. The electronic supervision unit comprises means for disconnecting the safety signal from the input circuit of the drive device/for connecting the safety signal to the input circuit of the drive device. The electronic supervision unit is arranged to bring the elevator into a state preventing a run by disconnecting the safety signal and to remove the state preventing a run by connecting the safety signal. Consequently the elevator can be brought into a safe state by disconnecting the safety signal with the electronic supervision unit, in which case when the safety signal is disconnected the power supply from the DC bus to the elevator motor ceases and the machinery brakes activate to brake the movement of the traction sheave of the hoisting machine of the elevator.

The signal permitting startup of a run can be conducted from the drive device to the electronic supervision unit, and the electronic supervision unit can be configured to read the status of the signal permitting startup of a run when the safety signal is disconnected. The electronic supervision unit can be arranged to prevent a run with the elevator, if the signal permitting startup of a run does not activate when the safety signal is disconnected. In this case the electronic supervision unit can monitor the operating condition of the drive prevention logic as well as of the brake drop-out logic on the basis of the signal permitting startup of a run. The electronic supervision unit can e.g. deduce that at least one or other of the drive prevention logic and brake drop-out logic is defective if the signal permitting startup of a run does not activate.

A data transfer bus can be formed between the electronic supervision unit and the drive device, and the drive device can comprise an input for the measuring data of the sensor measuring the state of motion of the elevator. The electronic supervision unit can be arranged to receive measuring data from the sensor measuring the state of motion of the elevator via the data transfer bus between the electronic supervision unit and the drive device. Consequently, the electronic supervision unit quickly detects a failure of the sensor measuring the state of motion of the elevator or of the measuring electronics, in which case the elevator system can be transferred with the control of the electronic supervision unit into a safe state as quickly as possible. The electronic supervision unit can also in this case monitor the operation of the drive device without separate monitoring means e.g. during emergency braking, in which case emergency braking can be performed subject to the supervision of the electronic supervision unit at a controlled deceleration with motor braking, which reduces the forces exerted on elevator passengers during an emergency stop. Namely, forces during an emergency stop that are too large might cause an elevator passenger unpleasant sensations or even result in a situation of real danger.

The drive device according to the invention is suited for use also in an elevator safety arrangement which comprises a safety circuit, which comprises mechanical safety switches fitted in series with each other, which safety switches are configured to monitor functions that are important from the viewpoint of the safety of the elevator. The signal conductor of the safety signal can be led from the safety circuit to the drive device. The safety circuit can comprise means for disconnecting the safety signal from the input circuit of the drive device and for connecting the safety signal to the input circuit of the drive device. The safety signal can be configured to be disconnected from the input circuit of the drive device by opening a safety switch in the safety circuit. Consequently, the drive device according to the invention can be connected as a part of an elevator safety arrangement that has a safety circuit by connecting the drive device via the safety signal to the safety circuit.

The safety arrangement can comprise an emergency drive device, which is connected to the DC bus of the drive device. The emergency drive device can comprise a secondary power source, via which electric power can be supplied to the DC bus during a malfunction of the primary power source of the elevator system. Both the emergency drive device and the drive device can be implemented fully without mechanical contactors. In the safety arrangement, the structure and placement of the drive prevention logic and of the brake drop-out logic also enable the power supply occurring from a secondary power source via the DC bus to the elevator motor and to an electromagnetic brake to be disconnected without a mechanical contactor.

The aforementioned secondary power source can be e.g. a generator, fuel cell, accumulator, supercapacitor or flywheel. If the secondary power source is rechargeable (e.g. an accumulator, supercapacitor, flywheel, some types of fuel cell), the electric power returning to the DC bus via the motor bridge during braking of the elevator motor can be charged into the secondary power source, in which case the efficiency ratio of the elevator system improves.

In one preferred embodiment of the invention the drive prevention logic is configured to prevent the passage of control pulses to the control poles of only the high-side switches, or alternatively to the control poles of only the low-side switches, of the motor bridge when the safety signal is disconnected. In the same context, dynamic braking of the elevator motor is implemented without any mechanical contactors using a bridge section controlling the motor bridge in the manner described in international patent application number WO 2008031915 A1, in which case dynamic braking from the elevator motor to the DC bus is possible even though the safety signal is disconnected and power supply from the DC bus towards the elevator motor is consequently prevented. The energy returning in dynamic braking can also be charged into the secondary power source of the emergency drive device, which improves the efficiency ratio of the elevator system.

In the most preferred embodiment of the invention both the drive prevention logic and the brake drop-out logic are implemented in the drive device of the elevator with solid-state components only. In a preferred embodiment of the invention the indicator logic is implemented in the drive device of the elevator with solid-state components only. The use of solid-state components instead of mechanical components such as relays and contactors is preferred owing to, inter alia, their better reliability and quieter operating noise. As the number of contactors decreases, also the wiring of the safety system of the elevator becomes simpler because connecting contactors usually requires separate cabling.

In some embodiments of the invention, the drive device and the safety arrangement of an elevator can be implemented without indicator logic, because with the brake drop-out logic and the drive prevention logic designed according to the invention, in themselves, an extremely high Safety Integrity Level can be achieved, even Safety Integrity Level SIL 3 according to standard EN IEC 61508, in which case separate measuring feedback (a signal permitting the starting of a run) about the operation of the drive prevention logic and of the brake drop-out logic is not necessarily needed.

According to the invention the safety signal is disconnected by disconnecting/preventing the passage of the safety signal to an input circuit with means to be arranged outside the drive device, and the safety signal is connected by allowing the passage of the safety signal to an input circuit with means to be arranged outside the drive device.

In one preferred embodiment of the invention the safety signal is divided into two separate safety signals, which can be disconnected/connected independently of each other, and the drive device comprises two input circuits, one each for both safety signals. The first of the input circuits is in this case connected to the drive prevention logic in such a way that the passage of control pulses to the control poles of the high-side switches and/or low-side switches of the motor bridge is prevented when the first of the aforementioned safety signals is disconnected, and the second of the input circuits is connected to the brake drop-out logic in such a way that the passage of control pulses to the control pole of the switch of the brake controller is prevented when the second of the aforementioned safety signals is disconnected. In this case the electronic supervision unit can comprise means for disconnecting the aforementioned safety signals independently of each other, in which case activation of the brake and disconnection of the power supply of the electric motor can be performed as two separate procedures, even at two different moments in time.

In the most preferred embodiment of the invention the safety signal is connected when a direct-voltage signal travels via the contact of the safety relay that is in the electronic supervision unit to the input circuit that is in the drive device, and the safety signal is disconnected when the passage of the direct-voltage signal to the drive device is disconnected by controlling the aforementioned contact of the safety relay open. Consequently, also detachment or cutting of the conductor of the safety signal results in disconnection of the safety signal, preventing the operation of the elevator system in a fail-safe manner. Also a transistor can be used in the electronic supervision unit instead of a safety relay for disconnecting the safety signal, preferably two or more transistors connected in series with each other, in which case a short-circuit of one transistor still does not prevent disconnection of the safety signal. An advantage in using a transistor is that with transistors the safety signal can, if necessary, be disconnected for a very short time, e.g. for a period of approx. 1 millisecond, in which case a short break can be filtered out of the safety signal in the input circuit of the drive device without it having an effect on the operation of the safety logic of the drive device. Consequently, the breaking capacity of the transistors can be monitored regularly, and even during a run with the elevator, by producing in the electronic supervision unit short breaks in the safety signal and by measuring the breaking capacity of the transistors in connection with a disconnection of the safety signal.

The preceding summary, as well as the additional features and additional advantages of the invention presented below, will be better understood by the aid of the following description of some embodiments, said description not limiting the scope of application of the invention.

BRIEF EXPLANATION OF THE FIGURES

FIG. 7 presents as a block diagram the fitting of an emergency drive device to the safety arrangement of an elevator according to FIG. 1.

MORE DETAILED DESCRIPTION OF PREFERRED EMBODIMENTS OF THE INVENTION

Figure 1:
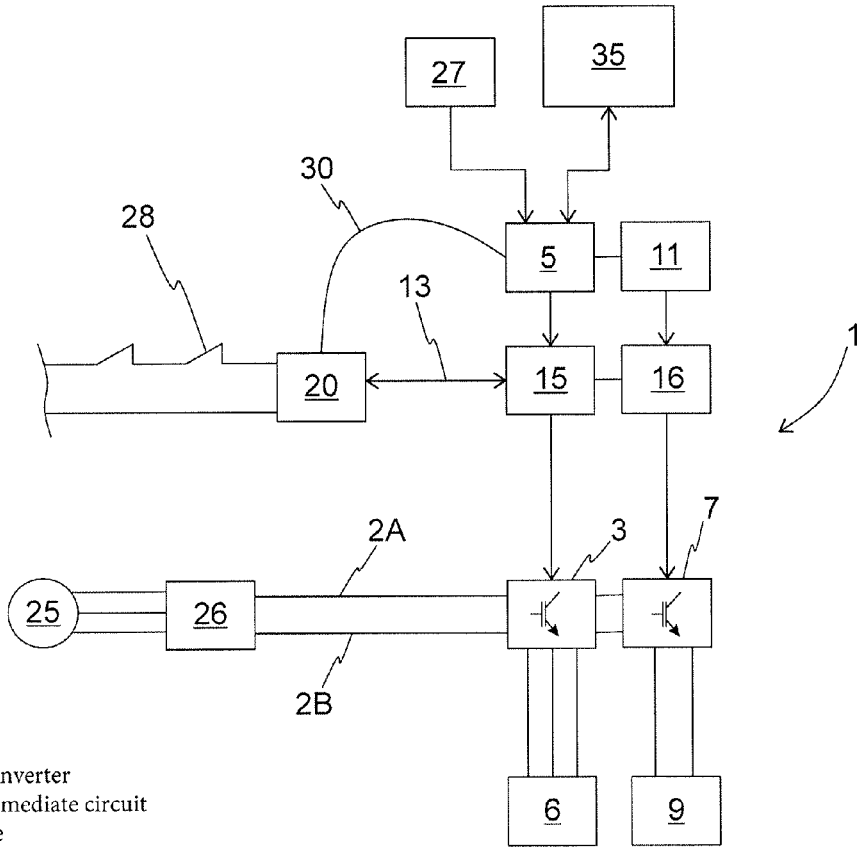
FIG. 1 presents as a block diagram one safety arrangement of an elevator according to the invention.

FIG. 1 presents as a block diagram a safety arrangement in an elevator system, in which an elevator car (not in figure) is driven in an elevator hoistway (not in figure) with the hoisting machine of the elevator via rope friction or belt friction. The speed of the elevator car is adjusted to be according to the target value for the speed of the elevator car, i.e. the speed reference, calculated by the elevator control unit 35. The speed reference is formed in such a way that the elevator car can transfer passengers from one floor to another on the basis of elevator calls given by elevator passengers.

The elevator car is connected to the counterweight with ropes or with a belt traveling via the traction sheave of the hoisting machine. Various roping solutions known in the art can be used in an elevator system, and they are not presented in more detail in this context. The hoisting machine also comprises an elevator motor, which is an electric motor 6, with which the elevator car is driven by rotating the traction sheave, as well as two electromagnet brakes 9, with which the traction sheave is braked and held in its position. The hoisting machine is driven by supplying electric power with the frequency converter 1 from the electricity network 25 to the electric motor 6. The frequency converter 1 comprises a rectifier 26, with which the voltage of the AC network 25 is rectified for the DC intermediate circuit 2A, 2B of the frequency converter. The DC voltage of the DC intermediate circuit 2A, 2B is further converted by the motor bridge 3 into the variable-amplitude and variable-frequency supply voltage of the electric motor 6. The circuit diagram of the motor bridge 3 is presented in FIG. 2. The motor bridge comprises high-side 4A and low-side 4B IGBT transistors, which are connected by producing with the control circuit 5 of the motor bridge short, preferably PWM (pulse-width modulation) modulated, pulses in the gates of the IGBT transistors. The control circuit 5 of the motor bridge can be implemented with e.g. a DSP processor. The IGBT transistors 4A of the high side are connected to the high voltage busbar 2A of the DC intermediate circuit and the IGBT transistors 4B of the low side are connected to the low voltage busbar 2B of the DC intermediate circuit. By connecting alternately the IGBT transistors of the high-side 4A and of the low-side 4B, a PWM modulated pulse pattern forms from the DC voltages of the high voltage busbar 2A and of the low voltage busbar 2B in the outputs R, S, T of the motor, the frequency of the pulses of which pulse pattern is essentially greater than the frequency of the fundamental frequency of the voltage. The amplitude and frequency of the fundamental frequency of the output voltages R, S, T of the motor can in this case be changed steplessly by adjusting the modulation index of the PWM modulation.

The control circuit 5 of the motor bridge also comprises a speed regulator, by means of which the speed of rotation of the rotor of the electric motor 6, and simultaneously the speed of the elevator car, are adjusted towards the speed reference calculated by the elevator control unit 35. The frequency converter 1 comprises an input for the measuring signal of a pulse encoder 27, with which signal the speed of rotation of the rotor of the electric motor 6 is measured for adjusting the speed.

During motor braking electric power also returns from the electric motor 6 via the motor bridge 3 back to the DC intermediate circuit 2A, 2B, from where it can be supplied onwards back to the electricity network 25 with a rectifier 26. On the other hand, the solution according to the invention can also be implemented with a rectifier 26, which is not of a type braking to the network, such as e.g. with a diode bridge. In this case during motor braking the power returning to the DC intermediate circuit can be converted into e.g. heat in a power resistor or it can be supplied to a separate temporary storage for electric power, such as to an accumulator or capacitor. During motor braking the force effect of the electric motor 6 is in the opposite direction with respect to the direction of movement of the elevator car. Consequently, motor braking occurs e.g. when driving an empty elevator car upwards, in which case the elevator car is braked with the electric motor 6, so that the counterweight pulls upwards with its gravitational force.

The electromagnetic brake 9 of the hoisting machine of an elevator comprises a frame part fixed to the frame of the hoisting machine and also an armature part movably supported on the frame part. The brake 9 comprises thruster springs, which resting on the frame part activate the brake by pressing the armature part to engage with the braking surface on the shaft of the rotor of the hoisting machine or e.g. on the traction sheave to brake the movement of the traction sheave. The frame part of the brake 9 comprises an electromagnet, which exerts a force of attraction between the frame part and the armature part. The brake is opened by supplying current to the control coil of the brake, in which case the force of attraction of the electromagnet pulls the armature part off the braking surface and the braking force effect ceases. Correspondingly, the brake is activated by dropping out the brake by disconnecting the current supply to the control coil of the brake.

Figure 3:
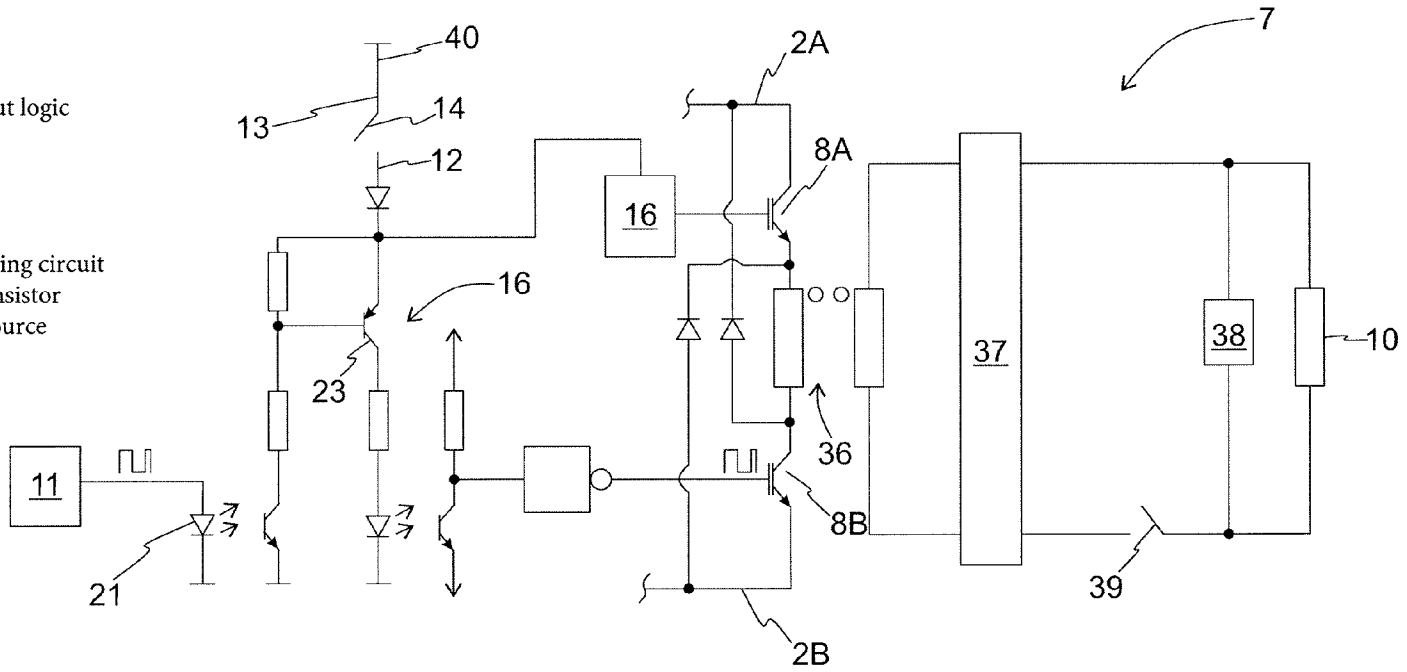
FIG. 3 presents a circuit diagram of the brake controller and the brake drop-out logic.

A brake controller 7 is integrated into the frequency converter 1, by the aid of which brake controller both the electromagnetic brakes 9 of the hoisting machine are controlled by supplying current separately to the control coil 10 of both electromagnetic brakes 9. The brake controller 7 is connected to the DC intermediate circuit 2A, 2B, and the current supply to the control coils of the electromagnetic brakes 9 occurs from the DC intermediate circuit 2A, 2B. The circuit diagram of the brake controller 7 is presented in more detail in FIG. 3. For the sake of clarity FIG. 3 presents a circuit diagram in respect of the electricity supply of only the one brake, because the circuit diagrams are similar for both brakes. Consequently the brake controller 7 comprises a separate transformer 36 for both brakes, with the primary circuit of which transformer two IGBT transistors 8A, 8B are connected in series in such a way that the primary circuit of the transformer 36 can be connected between the busbars 2A, 2B of the DC intermediate circuit by connecting the IGBT transistors 8A, 8B. The IGBT transistors are connected by producing with the brake control circuit 11 short, preferably PWM modulated, pulses in the gates of the IGBT transistors 8A, 8B. The brake control circuit 11 can be implemented with e.g. a DSP processor, and it can also connect to the same processor as the control circuit 5 of the motor bridge. The secondary circuit of the transformer 36 comprises a rectifier 37, by the aid of which the voltage induced when connecting the primary circuit to the secondary circuit is rectified and supplied to the control coil 10 of the electromagnetic brake, which control coil 10 is thus connected to the secondary side of the rectifier 36. In addition, a current damping circuit 38 is connected in parallel with the control coil 10 to the secondary side of the transformer, which current damping circuit comprises one or more components (e.g. a resistor, capacitor, varistor, et cetera), which receive(s) the energy stored in the inductance of the control coil of the brake in connection with disconnection of the current of the control coil 10, and consequently accelerate(s) disconnection of the current of the control coil 10 and activation of the brake 9. Accelerated disconnection of the current occurs by opening the MOSFET transistor 39 in the secondary circuit of the brake controller, in which case the current of the coil 10 of the brake commutates to travel via the current damping circuit 38. The brake controller to be implemented with the transformer described here is particularly fail-safe, especially from the viewpoint of earth faults, because the power supply from the DC intermediate circuit 2A, 2B to both current conductors of the control coil 10 of the brake disconnects when the modulation of the IGBT transistors 8A, 8B on the primary side of the transformer 36 ceases.

The safety arrangement of an elevator according to FIG. 1 comprises mechanical normally-closed safety switches 28, which are configured to supervise the position/locking of entrances to the elevator hoistway as well as e.g. the operation of the overspeed governor of the elevator car. The safety switches of the entrances of the elevator hoistway are connected to each other in series. Opening of a safety switch 28 consequently indicates an event affecting the safety of the elevator system, such as the opening of an entrance to the elevator hoistway, the arrival of the elevator car at an extreme limit switch for permitted movement, activation of the overspeed governor, et cetera.

The safety arrangement of the elevator comprises an electronic supervision unit 20, which is a special microprocessor-controlled safety device fulfilling the EN IEC 61508 safety regulations and designed to comply with SIL 3 safety integrity level. The safety switches 28 are wired to the electronic supervision unit 20. The electronic supervision unit 20 is also connected with a communications bus 30 to the frequency converter 1, to the elevator control unit 35 and to the control unit of the elevator car, and the electronic supervision unit 20 monitors the safety of the elevator system on the basis of data it receives from the safety switches 28 and from the communications bus. The electronic supervision unit 20 forms a safety signal 13, on the basis of which a run with the elevator can be allowed or, on the other hand, prevented by disconnecting the power supply of the elevator motor 6 and by activating the machinery brakes 9 to brake the movement of the traction sheave of the hoisting machine. Consequently, the electronic supervision unit 20 prevents a run with the elevator e.g. when detecting that an entrance to the elevator hoistway has opened, when detecting that an elevator car has arrived at the extreme limit switch for permitted movement, and when detecting that the overspeed governor has activated. In addition, the electronic supervision unit receives the measuring data of a pulse encoder 27 from the frequency converter 1 via the communications bus 30, and monitors the movement of the elevator car in connection with, inter alia, an emergency stop on the basis of the measuring data of the pulse encoder 27 it receives from the frequency converter 1.

Figure 6:
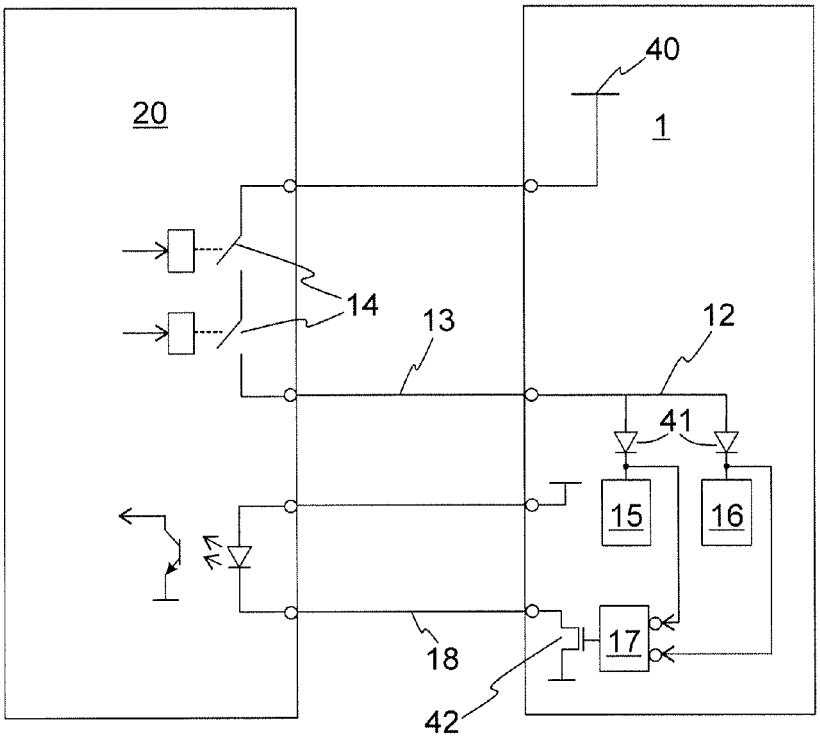
FIG. 6 presents the circuit of the safety signal in a safety arrangement of an elevator according to FIG. 1.

The frequency converter 1 is provided with a special safety logic 15, 16 to be connected to the signal path of the safety signal, by means of which safety logic disconnection of the power supply of the elevator motor 6 as well as activation of the machinery brakes can be performed without mechanical contactors, using just solid-state components, which improve the safety and reliability of the elevator system compared to a solution implemented with mechanical contactors. The safety logic is formed from the drive prevention logic 15, the circuit diagram of which is presented in FIG. 2, and also from the brake drop-out logic 16, the circuit diagram of which is presented in FIG. 3. In addition, the frequency converter 1 comprises indicator logic 17, which forms data about the operating state of the drive prevention logic 15 and of the brake drop-out logic 16 for the electronic supervision unit 20. FIG. 6 presents how the safety functions of the aforementioned electronic supervision unit 20 and of the frequency converter 1 are connected together into a safety circuit of the elevator.

Figure 2:
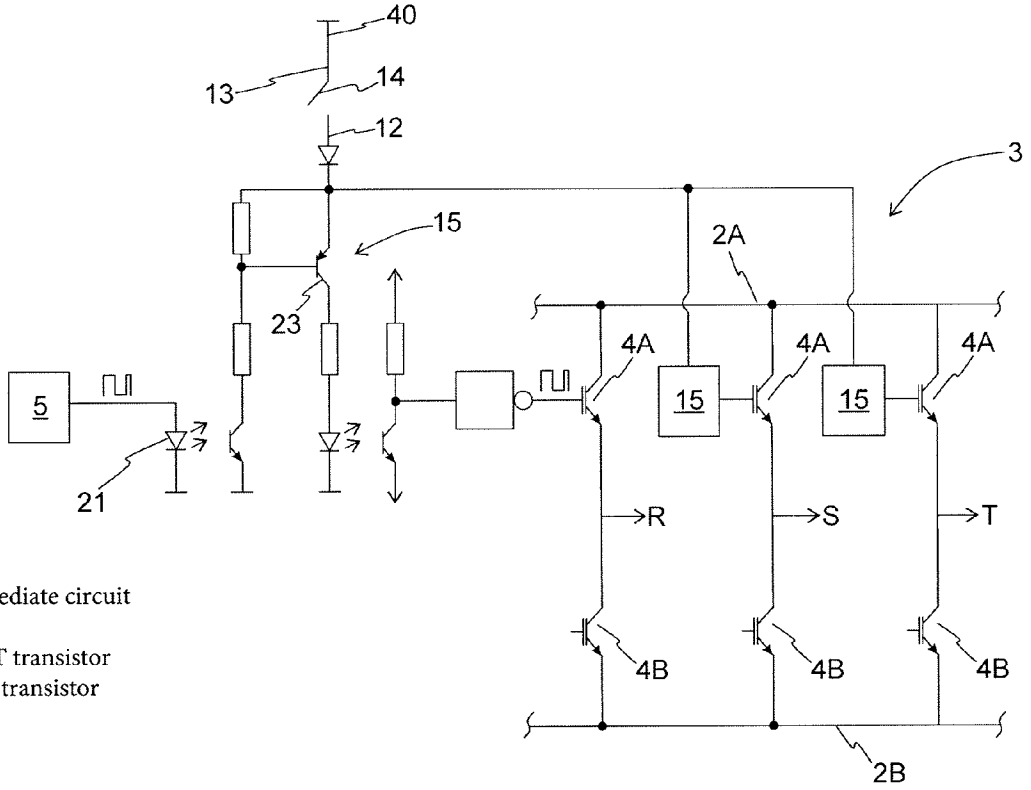
FIG. 2 presents a circuit diagram of the motor bridge and the drive prevention logic.

According to FIG. 2, the drive prevention logic 15 is fitted to the signal path between the control circuit 5 of the motor bridge and the control gate of each high-side IGBT transistor 4A. The drive prevention logic 15 comprises a PNP transistor 23, the emitter of which is connected to the input circuit 12 of the safety signal 13 in such a way that the electricity supply to the drive prevention logic 15 occurs from the DC voltage source 40 via the safety signal 13. The safety signal 13 travels via a contact of the safety relay 14 of the electronic supervision unit 20, in which case the electricity supply from the DC voltage source 40 to the emitter of the PNP transistor 23 disconnects, when the contact 14 of the safety relay of the electronic supervision unit 20 opens. Although FIGS. 2 and 3 present only one contact 14 of the safety relay, in practice the electronic supervision unit 20 comprises two safety relays/contacts 14 of the safety relay connected in series with each other, with which it is thus endeavored to ensure the reliability of disconnection. When the contacts 14 of the safety relay open, the signal path of the control pulses from the control circuit 5 of the motor bridge to the control gates of the high-side IGBT transistors 4A of the motor bridge is disconnected at the same time, in which case the high-side IGBT transistors 4A open and the power supply from the DC intermediate circuit 2A, 2B to the phases R, S, T of the electric motor ceases. The circuit diagram of the drive prevention logic 15 in FIG. 2 for the sake of simplicity is presented only in respect of the R phase because the circuit diagrams of the drive prevention logic 15 are similar also in connection with the S and T phases.

The power supply to the electric motor 6 is prevented as long as the safety signal 13 is disconnected, i.e. the contact of the safety relay 14 is open. The electronic supervision unit 20 connects the safety signal 13 by controlling the contact of the safety relay 14 closed, in which case DC voltage is connected from the DC voltage source 40 to the emitter of the PNP transistor 23. In this case the control pulses are able to travel from the control circuit 5 of the motor bridge via the collector of the PNP transistor 23 and onwards to the control gates of the high-side IGBT transistors 4A, which enables a run with the motor. Since a failure of the PNP transistor 23 might otherwise cause the control pulses to travel to the high-side IGBT transistors 4A although the voltage supply to the emitter of the PNP transistor has in fact been cut (the safety signal has been disconnected), the signal path of the control pulses from the control circuit 5 of the motor bridge to the drive prevention logic 15 is also arranged to travel via an opto-isolator 21.

According to FIG. 2, the circuit of the PNP transistor 23 also tolerates well EMC interference connecting to the signal conductors of the safety signal 13 that travel outside the frequency converter, preventing its access to the drive prevention logic 15.

According to FIG. 3 the brake drop-out logic 16 is fitted to the signal path between the brake control circuit 11 and the control gates of the IGBT transistors 8A, 8B of the brake controller 7. Also the brake drop-out logic 16 comprises a PNP transistor 23, the emitter of which is connected to the same input circuit 12 of the safety signal 13 as the drive prevention logic. Consequently the electricity supply from the DC voltage source 40 to the emitter of the PNP transistor 23 of the brake drop-out logic 16 disconnects, when the contact 14 of the safety relay of the electronic supervision unit 20 opens. At the same time the signal path of the control pulses from the brake control circuit 11 to the control gates of the IGBT transistors 8A, 8B of the brake controller 7 is disconnected, in which case the IGBT transistors 8A, 8B open and the power supply from the DC intermediate circuit 2A, 2B to the coil 10 of the brake ceases. The circuit diagram of the brake drop-out logic 16 in FIG. 3 for the sake of simplicity is presented only in respect of the IGBT transistor 8B connecting to the low-voltage busbar 2B of the DC intermediate circuit, because the circuit diagram of the brake drop-out logic 16 is similar also in connection with the IGBT transistor 8A connecting to the high-voltage busbar 2A of the DC intermediate circuit.

Power supply from the DC intermediate circuit 2A, 2B to the coil of the brake is again possible after the electronic supervision unit 20 connects the safety signal 13 by controlling the contact of the safety relay 14 closed, in which case DC voltage is connected from the DC voltage source 40 to the emitter of the PNP transistor 23 of the brake drop-out logic 16. Also the signal path of the control pulses formed by the brake control circuit 11 to the brake drop-out logic 16 is arranged to travel via an opto-isolator 21, for the same reasons as stated in connection with the above description of the drive prevention logic. Since the switching frequency of the IGBT transistors 8A, 8B of the brake controller 7 is generally very high, even 20 kilohertz or over, the opto-isolator 21 must be selected in such a way that the latency of the control pulses through the opto-isolator 21 is minimized.

Figure 4:
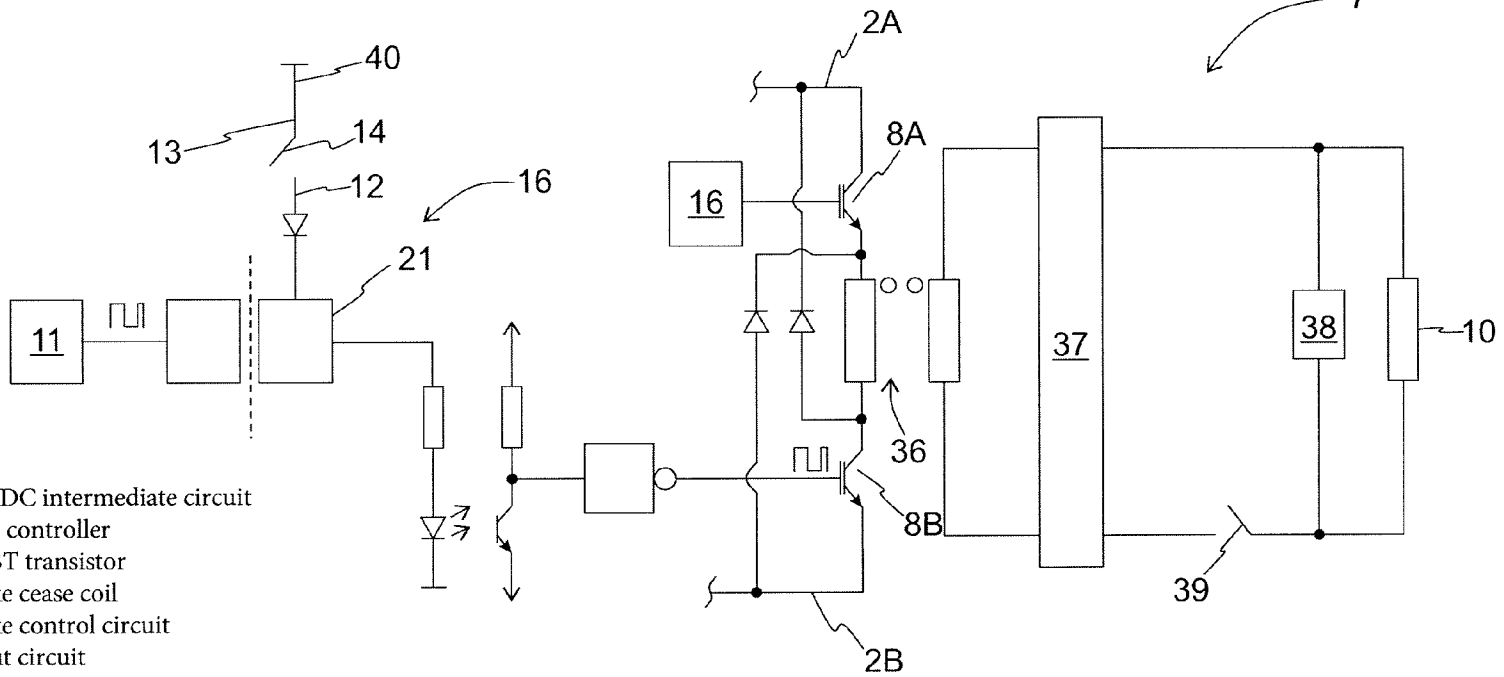
FIG. 4 presents an alternative circuit diagram of the brake controller and the brake drop-out logic.

Instead of an opto-isolator 21, also a digital isolator can be used for minimizing the latency. FIG. 4 presents an alternative circuit diagram of the brake drop-out logic, which differs from the circuit diagram of FIG. 3 in such a way that the opto-isolator 21 has been replaced with a digital isolator. One possible digital isolator 21 of FIG. 4 is that with an ADUM 4223 type marking manufactured by Analog Devices. The digital isolator 21 receives its operating voltage for the secondary side from a DC voltage source 40 via the contact 14 of the safety relay, in which case the output of the digital isolator 21 ceases modulating when the contact 14 opens.

Figure 5:
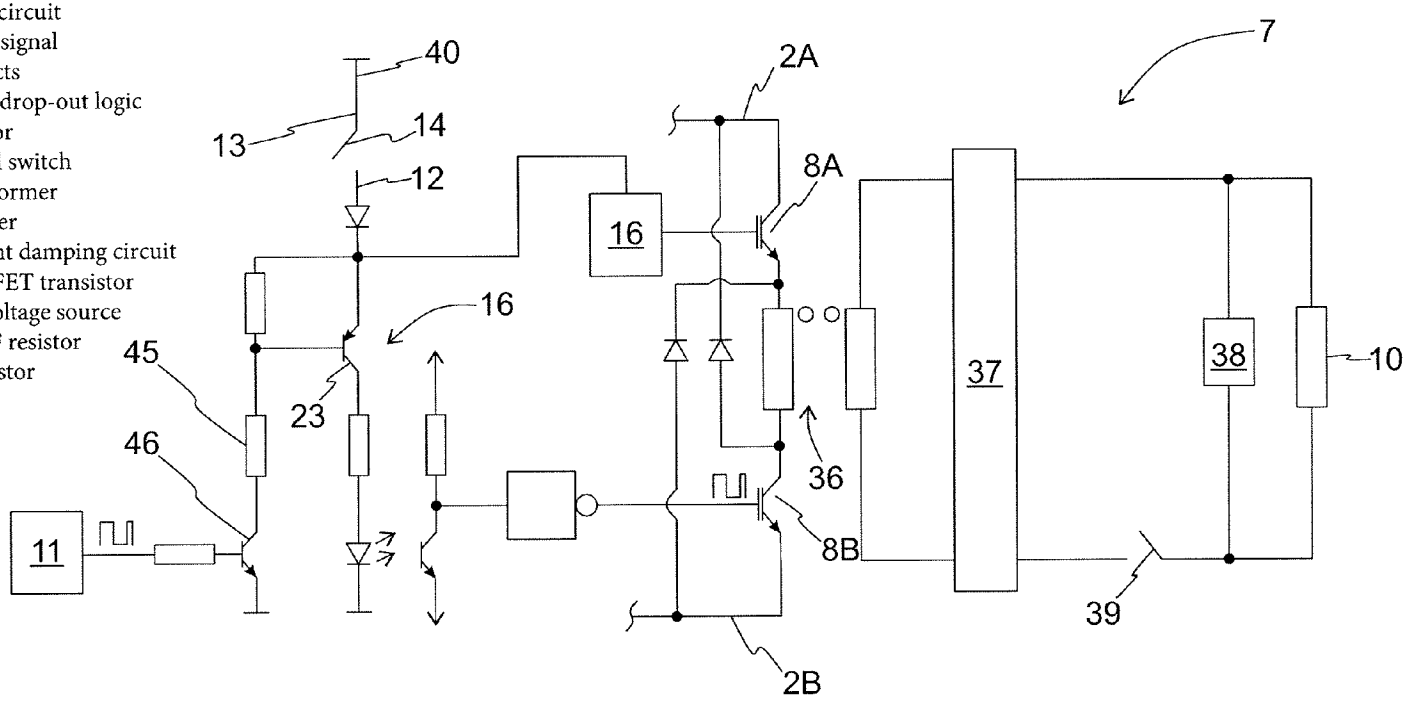
FIG. 5 presents another alternative circuit diagram of the brake controller and the brake drop-out logic.

FIG. 5 presents yet another alternative circuit diagram of the brake drop-out logic. The circuit diagram of FIG. 5 differs from the circuit diagram of FIG. 3 in such a way that the opto-isolator 21 has been replaced with a transistor 46, and the output of the brake control circuit 11 has been taken directly to the gate of the transistor 46. An MELF resistor 45 is connected to the collector of the transistor 46. Elevator safety instruction EN 81-20 specifies that failure of an MELF resistor into a short-circuit does not need to be taken into account when making a fault analysis, so that by selecting the value of the MELF resistor to be sufficiently large, a signal path from the output of the brake control circuit 11 to the gate of an IGBT transistor 8A, 8B can be prevented when the safety contact 14 is open. In this way a simple and cheap drop-out logic for a brake is achieved.

In some embodiments the circuit diagram of the drive prevention logic of FIG. 2 has been replaced with the circuit diagram of the brake drop-out logic according to FIG. 4 or 5. In this way the transit time latency of the signal from the output of the control circuit 5 of the motor bridge to the gate of the IGBT transistor 4A, 4B can be reduced in the drive prevention logic.

According to FIG. 6 the safety signal 13 is conducted from the DC voltage source 40 of the frequency converter 1 via the contacts 14 of the safety relay of the electronic supervision unit 20 and onwards back to the frequency converter 1, to the input circuit 12 of the safety signal. The input circuit 12 is connected to the drive prevention logic 15 and also to the brake drop-out logic 16 via the diodes 41. The purpose of the diodes 41 is to prevent voltage supply from the drive prevention logic 15 to the brake drop-out logic 16/from the brake drop-out logic 16 to the drive prevention logic 15 as a consequence of a failure, such as a short-circuit et cetera, occurring in the drive prevention logic 15 or in the brake drop-out logic 16.

Additionally, the frequency converter comprises indicator logic 17, which forms data about the operating state of the drive prevention logic 15 and of the brake drop-out logic 16 for the electronic supervision unit 20. The indicator logic 17 is implemented as AND logic, the inputs of which are inverted. A signal allowing startup of a run is obtained as the output of the indicator logic, which signal reports that the drive prevention logic 15 and the brake drop-out logic are in operational condition and starting of the next run is consequently allowed. For activating the signal 18 allowing the startup of a run, the electronic supervision unit 20 disconnects the safety signal 13 by opening the contacts 14 of the safety relay, in which case the electricity supply of the drive prevention logic 15 and of the brake drop-out logic 16 must go to zero, i.e. the supply of control pulses to the high-side IGBT transistors 4A of the motor bridge and to the IGBT transistors 8A, 8B of the brake controller is prevented. If this happens, the indicator logic 17 activates the signal 18 permitting startup of a run by controlling the transistor 42 to be conductive. The output of the transistor 42 is wired to the electronic supervision unit 20 in such a way that current flows in the opto-isolator in the electronic supervision unit 20 when the transistor 42 conducts, and the opto-isolator indicates to the electronic supervision unit 20 that the startup of a run is allowed. If at least either one of the electricity supplies of the drive prevention logic and brake drop-out logic does not go to zero after the contact 14 of the safety relay has opened in the electronic supervision unit 20, the transistor 42 does not start to conduct and the electronic supervision unit 20 deduces on the basis of this that the safety logic of the frequency converter 1 has failed. In this case the electronic supervision unit prevents the starting of the next run and sends data about prevention of the run to the frequency converter 1 and to the elevator control unit 35 via the communications bus 30.

FIG. 7 presents one embodiment of the invention, in which an emergency drive apparatus 32 has been added to the safety arrangement according to FIG. 1, by means of which apparatus the operation of the elevator can be continued during a functional nonconformance of the electricity network, such as during an overload or an electricity outage. The emergency drive apparatus comprises a battery pack 33, preferably a lithium-ion battery pack, which is connected to the DC intermediate circuit 2A, 2B with a DC/DC transformer 43, by means of which electric power can be transmitted in both directions between the battery pack 33 and the DC intermediate circuit 2A, 2B. The emergency drive device is controlled in such a way that the battery pack 33 is charged with the electric motor 6 when braking and current is supplied from the battery pack to the electric motor 6 when driving with the electric motor 6. According to the invention also the electricity supply occurring from the battery pack 33 via the DC intermediate circuit 2A, 2B to the electric motor 6 as well as to the brakes 9 can be disconnected using the drive prevention logic 15 and the brake drop-out logic 16, in which case also the emergency drive apparatus 32 can be implemented without adding a single mechanical contactor to the emergency drive apparatus 32/frequency converter 1.

Figure 8:
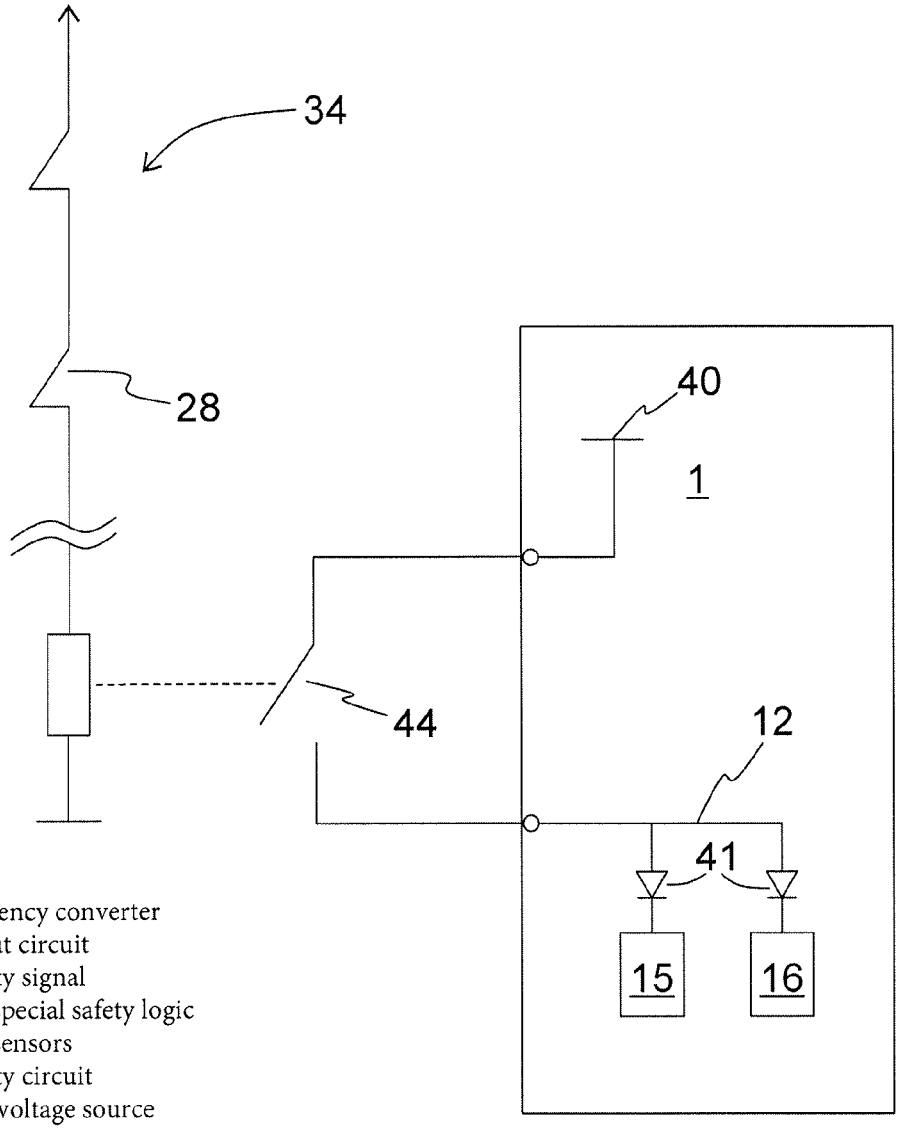
FIG. 8 presents as a circuit diagram the fitting of a drive device according to the invention into connection with the safety circuit of an elevator.

FIG. 8 presents an embodiment of the invention in which the safety logic of the frequency converter 1 according to the invention is fitted into an elevator having a conventional safety circuit 34. The safety circuit 34 is formed from safety switches 28, such as e.g. safety switches of the doors of entrances to the elevator hoistway, that are connected together in series. The coil of the safety relay 44 is connected in series with the safety circuit 34. The contact of the safety relay 44 opens, when the current supply to the coil ceases as the safety switch 28 of the safety circuit 34 opens. Consequently the contact of the safety relay 44 opens e.g. when a serviceman opens the door of an entrance to the elevator hoistway with a service key. The contact of the safety relay 44 is wired from the DC voltage source 40 of the frequency converter 1 to the common input circuit 12 of the drive prevention logic 15 and the brake drop-out logic 16 in such a way that the electricity supply to the drive prevention logic 15 and brake drop-out logic 16 ceases when the contact of the safety relay 44 opens. Consequently, when the safety switch 28 opens in the safety circuit 34, the passage of control pulses to the control gates of the high-side IGBT transistors 4A of the motor bridge 3 of the frequency converter 1 ceases, and the power supply to the electric motor 6 of the hoisting machine of the elevator is disconnected. At the same time also the passage of control pulses to the IGBT transistors 8A, 8B of the brake controller 7 ceases, and the brakes 9 of the hoisting machine activate to brake the movement of the traction sheave of the hoisting machine.

It is obvious to the person skilled in the art that, differing from what is described above, the electronic supervision unit 20 can also be integrated into the frequency converter 1, preferably on the same circuit card as the drive prevention logic 15 and/or the brake drop-out logic 16. In this case the electronic supervision unit 20 and the drive prevention logic 15/brake drop-out logic 16 form, however, subassemblies that are clearly distinguishable from each other, so that the fail-safe apparatus architecture according to the invention is not fragmented.

The invention is described above by the aid of a few examples of its embodiment. It is obvious to the person skilled in the art that the invention is not only limited to the embodiments described above, but that many other applications are possible within the scope of the inventive concept defined by the claims.

The invention claimed is:

1. A drive device of an elevator, comprising:

a DC bus;

a motor bridge connected to the DC bus for the electricity supply of the elevator motor, said motor bridge comprising high-side and low-side switches for supplying electric power from the DC bus to the elevator motor when driving with the elevator motor, and also from the elevator motor to the DC bus when braking with the elevator motor;

a control circuit of the motor bridge, with which control circuit the operation of the motor bridge is controlled by producing control pulses in the control poles of the high-side and low-side switches of the motor bridge;

a brake controller, which comprises a switch for supplying electric power to the control coil of an electromagnetic brake;

a brake control circuit, with which the operation of the brake controller is controlled by producing control pulses in the control pole of the switch of the brake controller;

an input circuit for a safety signal, which safety signal can be disconnected/connected from outside the drive device;

drive prevention logic, which is connected to the input circuit and is configured to prevent the passage of control pulses to the control poles of the high-side and/or low-side switches of the motor bridge when the safety signal is disconnected; and brake drop-out logic, which is connected to the input circuit and is configured to prevent passage of the control pulses to the control pole of the switch of the brake controller when the safety signal is disconnected.

2. The drive device according to claim 1, wherein:

the brake controller is connected to the DC bus; and the switch is configured to supply electric power from the DC bus to the control coil of an electromagnetic brake.

3. The drive device according to claim 1, wherein:

the drive prevention logic is configured to allow passage of the control pulses to the control poles of the switches of the motor bridge when the safety signal is connected; and the brake drop-out logic is configured to allow passage of the control pulses to the control pole of the switch of the brake controller when the safety signal is connected.

4. The drive device according to claim 1, wherein:

the drive device comprises indicator logic for forming a signal permitting startup of a run;

the indicator logic is configured to activate the signal permitting startup of a run when both the drive prevention logic and the brake drop-out logic are in a state preventing the passage of control pulses;

the indicator logic is configured to disconnect the signal permitting startup of a run if at least either one of the drive prevention logic and the brake drop-out logic are in a state permitting the passage of control pulses; and the drive device comprises an output for indicating the signal permitting startup of a run to a supervision logic external to the drive device.

5. The drive device according to claim 1, wherein:

the signal path of the control pulses to the control poles of the high-side and/or low-side switches of the motor bridge travels via the drive prevention logic; and the electricity supply to the drive prevention logic is arranged via the signal path of the safety signal.

6. The drive device according to claim 1, wherein the signal path of the control pulses from the control circuit of the motor bridge to the drive prevention logic is arranged via an isolator.

7. The drive device according to claim 1, wherein:

the signal path of the control pulses travel to the control pole of the switch of the brake controller travels via the brake drop-out logic; and the electricity supply to the brake drop-out logic is arranged via the signal path of the safety signal.

8. The drive device according to claim 1, wherein the signal path of the control pulses from the brake control circuit to the brake drop-out logic is arranged via an isolator.

9. The drive device according to claim 1, wherein:

the drive prevention logic comprises a bipolar or multipolar signal switch, via which the control pulses travel to the control pole of a switch of the motor bridge; and at least one pole of the signal switch is connected to the input circuit in such a way that the signal path of the control pulses through the signal switch breaks when the safety signal is disconnected.

10. The drive device according to claim 9, wherein the signal switch is fitted in connection with the control pole of each high-side switch of the motor bridge and/or in connection with the control pole of each low-side switch of the motor bridge.

11. The drive device according to claim 1, wherein:

the brake drop-out logic comprises a bipolar or multipolar signal switch , via which the control pulses travel to the control pole of the switch of the brake controller; and at least one pole of the signal switch is connected to the input circuit in such a way that the signal path of the control pulses through the signal switch breaks when the safety signal is disconnected.

12. The drive device according to claim 5, wherein the electricity supply occurring via the signal path of the safety signal is configured to be disconnected by disconnecting the safety signal.

13. The drive device according to claim 1, wherein the drive device comprises a rectifier connected between the AC electricity source and the DC bus.

14. The drive device according to claim 1, wherein the drive device is implemented without any mechanical contactors.

15. The drive device according to claim 2, wherein:

the drive prevention logic is configured to allow passage of the control pulses to the control poles of the switches of the motor bridge when the safety signal is connected; and the brake drop-out logic is configured to allow passage of the control pulses to the control pole of the switch of the brake controller when the safety signal is connected.

16. The drive device according to claim 2, wherein:

the drive device comprises indicator logic for forming a signal permitting startup of a run;

the indicator logic is configured to activate the signal permitting startup of a run when both the drive prevention logic and the brake drop-out logic are in a state preventing the passage of control pulses;

the indicator logic is configured to disconnect the signal permitting startup of a run if at least either one of the drive prevention logic and the brake drop-out logic are in a state permitting the passage of control pulses; and the drive device comprises an output for indicating the signal permitting startup of a run to a supervision logic external to the drive device.

17. The drive device according to claim 3, wherein:

the drive device comprises indicator logic for forming a signal permitting startup of a run;

the indicator logic is configured to activate the signal permitting startup of a run when both the drive prevention logic and the brake drop-out logic are in a state preventing the passage of control pulses;

the indicator logic is configured to disconnect the signal permitting startup of a run if at least either one of the drive prevention logic and the brake drop-out logic are in a state permitting the passage of control pulses; and the drive device comprises an output for indicating the signal permitting startup of a run to a supervision logic external to the drive device.

18. The drive device according to claim 2, wherein:

the signal path of the control pulses to the control poles of the high-side and/or low-side switches of the motor bridge travels via the drive prevention logic; and the electricity supply to the drive prevention logic is arranged via the signal path of the safety signal.

19. The drive device according to claim 3, wherein:

the signal path of the control pulses to the control poles of the high-side and/or low-side switches of the motor bridge travels via the drive prevention logic; and the electricity supply to the drive prevention logic is arranged via the signal path of the safety signal.

20. The drive device according to claim 4, wherein:

the signal path of the control pulses to the control poles of the high-side and/or low-side switches of the motor bridge travels via the drive prevention logic; and the electricity supply to the drive prevention logic is arranged via the signal path of the safety signal.

* * * * *